US010603668B2

(12) United States Patent
Fischer et al.

(10) Patent No.: US 10,603,668 B2
(45) Date of Patent: Mar. 31, 2020

(54) SECURING THE SHAFT IN A CONE CRUSHER

(71) Applicants: TK Industrial Solutions AG, Essen (DE); ThyssenKrupp AG, Essen (DE)

(72) Inventors: Siegbert Fischer, Ennigerloh (DE); Hans Jürgen Mecke, Duisburg (DE)

(73) Assignees: THYSSENKRUPP INDUSTRIAL SOLUTIONS AG, Essen (DE); THYSSENKRUPP AG, Essen (DE)

( * ) Notice: Subject to any disclaimer, the term of this patent is extended or adjusted under 35 U.S.C. 154(b) by 552 days.

(21) Appl. No.: 15/302,091

(22) PCT Filed: Mar. 31, 2015

(86) PCT No.: PCT/EP2015/057014

§ 371 (c)(1),
(2) Date: Oct. 5, 2016

(87) PCT Pub. No.: WO2015/155062

PCT Pub. Date: Oct. 15, 2015

(65) Prior Publication Data

US 2017/0113226 A1 Apr. 27, 2017

(30) Foreign Application Priority Data

Apr. 9, 2014 (DE) ..... 10 2014 105 046

(51) Int. Cl.
*B02C 2/04* (2006.01)
*B02C 2/06* (2006.01)
*B02C 2/00* (2006.01)

(52) U.S. Cl.
CPC ..... *B02C 2/04* (2013.01); *B02C 2/00* (2013.01); *B02C 2/047* (2013.01); *B02C 2/06* (2013.01)

(58) Field of Classification Search
CPC .. B02C 2/00; B02C 2/04; B02C 2/047; B02C 2/06; B02C 2/02
(Continued)

(56) References Cited

U.S. PATENT DOCUMENTS 2,409,391 A * 10/1946 Rumpel ..... B02C 2/045 241/208
3,337,143 A 8/1967 Johnson
(Continued)

FOREIGN PATENT DOCUMENTS

CN 2255874 Y 6/1997
CN 201552023 U 8/2010
(Continued)

OTHER PUBLICATIONS

English language Abstract for CN 201552023 U listed above.
(Continued)

*Primary Examiner* — Gregory D Swiatocha
*Assistant Examiner* — Katie L. Parr
(74) *Attorney, Agent, or Firm* — thyssenkrupp North America, Inc.

(57) ABSTRACT

A cone crusher may include a crushing cone held on a driven eccentric bushing. The eccentric bushing may rotate in a radial direction about a spindle. The spindle may be fixedly clamped in a spindle receptacle provided in a housing lower part. The spindle may comprise a cylindrical upper bearing portion that is braced in a bore that forms the spindle receptacle by way of an upper mechanical clamping device.

10 Claims, 2 Drawing Sheets

(58) Field of Classification Search
USPC ..... 241/207, 209–214
See application file for complete search history.

(56) References Cited

U.S. PATENT DOCUMENTS 3,339,852 A * 9/1967 Thomas ..... B02C 2/06 241/156
3,539,119 A * 11/1970 Cook ..... B02C 2/047 241/215
3,887,143 A * 6/1975 Gilbert ..... B02C 2/04 241/215
4,232,833 A 11/1980 Werginz
4,367,053 A * 1/1983 Stratienko ..... F16D 1/094 403/371
4,467,971 A * 8/1984 Schuman ..... B02C 2/047 241/215
6,213,418 B1 * 4/2001 Gabriel ..... B02C 2/04 241/207
7,566,018 B1 * 7/2009 Brown ..... B02C 2/04 241/207
7,631,826 B2 * 12/2009 Tamura ..... B02C 13/10 241/154
7,762,482 B2 * 7/2010 Van Der Wal ..... B02C 18/148 241/23
7,942,354 B2 * 5/2011 Didion ..... B02C 17/002 241/74

FOREIGN PATENT DOCUMENTS

| | | | |
|---|---|---|---|
| CN | 103691509 | A | 4/2014 |
| DE | 1027042 | | 3/1958 |
| FR | 849991 | A | 12/1939 |
| KR | 100901308 | B1 | 6/2009 |
| WO | 2012140307 | A1 | 10/2012 |

OTHER PUBLICATIONS

English language Abstract for CN 103691509 A listed above.
English language Abstract for CN 2255874 Y listed above.
English language Abstract for KR 100901308 B1 listed above.
Int'l Search Report for PCT/EP2015/057014 dated Jun. 2, 2015 (dated Jun. 12, 2015).
Machine Translation of DE1027042.

* cited by examiner

SECURING THE SHAFT IN A CONE CRUSHER

CROSS REFERENCE TO RELATED APPLICATIONS

This application is a U.S. National Stage Entry of International Patent Application Serial Number PCT/EP2015/057014, filed Mar. 31, 2015, which claims priority to German Patent Application No. DE 10 2014 105 046.0 filed Apr. 9, 2014, the entire contents of both of which are incorporated herein by reference.

FIELD

The present disclosure relates to cone crushers and, more particularly, to cone crushers that include an eccentric bushing that rotates about a spindle.

BACKGROUND

Cone crushers of this type, but also gyratory crushers have long been known from the prior art. In accordance with their intended use, the mass comminution of pieces of rock, they are exposed in a harsh environment to large loads and to correspondingly high wear. In order to be able to ensure reliable operation, the wearing parts, including in particular the crushing cone held on the cone carrier and also the mounting of the cone carrier, have to be exchanged from time to time. It is advantageous for the service life if these operations can be performed quickly in situ. Since, however, the external conditions in situ are highly uncomfortable and the personnel used for the maintenance work sometimes become impatient because of the failure-induced delay, the moves have to be able to be performed simply and without a particular outlay on tools. In particular, the use of a heavy tool should be avoided as far as possible because of the risk of damage to the crushers.

Support of the spindle within the housing, as disclosed, for example, in the prior art according to DE 1 027 042, has long proven successful. In this case, a bell-shaped eccentric bushing having a correspondingly bell-shaped crushing cone is pulled over a fixed spindle. The eccentric bushing is set into rotation by an external motor via a bevel gear and a horizontally lying drive shaft. The spindle is clamped in the housing lower part via a conical seat which has a self-locking action. For the vertical securing and for the correction of the fitted position of the spindle, it is known to use a shaft nut at the lower end of the spindle in order additionally to brace the spindle against the housing part.

However, to manufacture the conical seat surfaces on the spindle and in the housing lower part is particularly complicated because of the required precision. This applies especially to modern cone crushers in which the spindles have a length of more than one meter. To manufacture conical seats at this length is at least complicated, if not even impossible—at least to the precision required, in particular where the oil ducts running in the spindle are dependent on the precise axial positioning. Furthermore, it is difficult to remove a spindle, which is being pressed fixedly into its conical bearing by the operation, for repair. Even with the aid of pressurized oil assemblies, the release of a spindle from its conical seat is not always ensured, and therefore a heavy tool is used.

DETAILED DESCRIPTION

Figure 1:
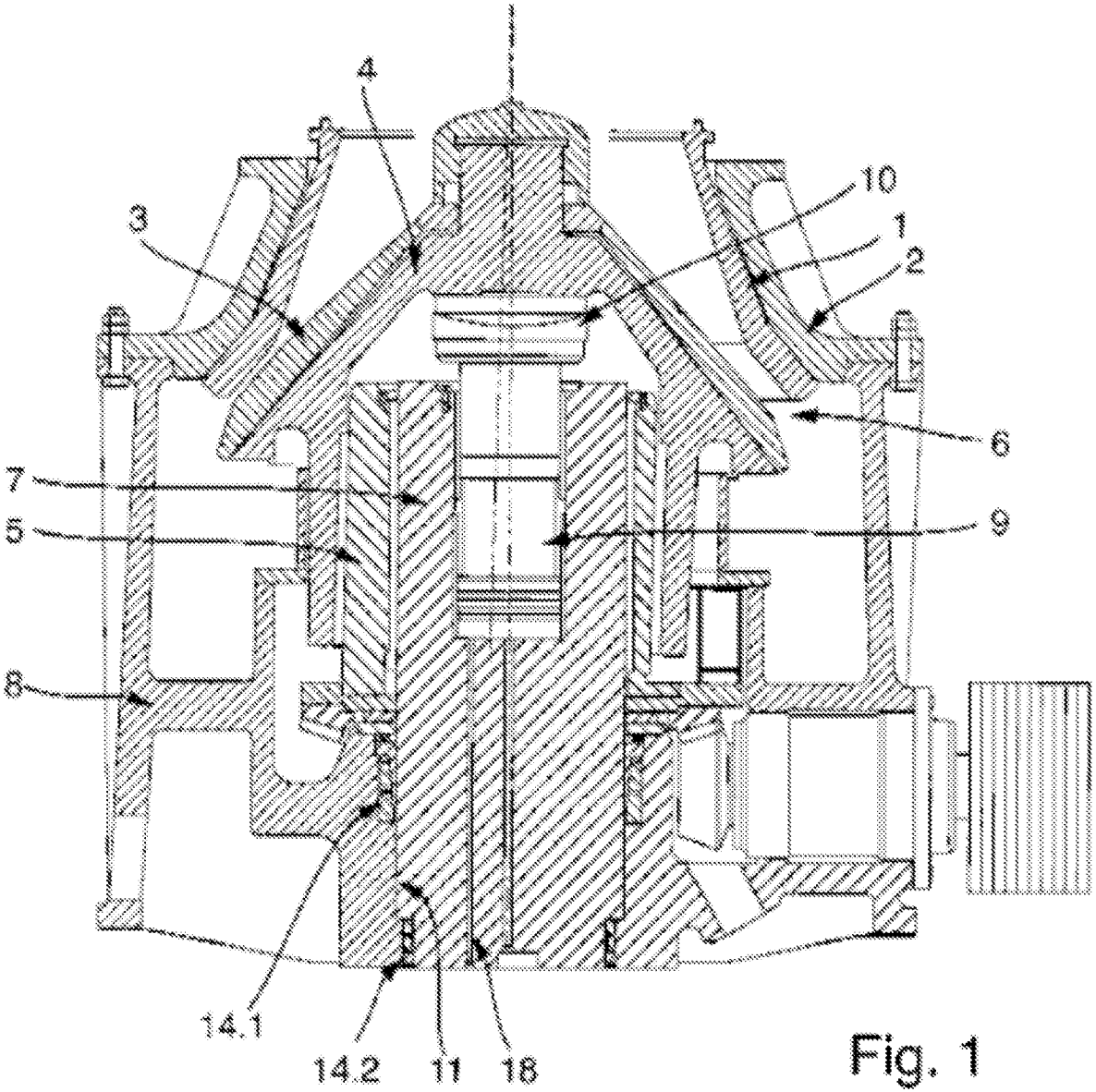
FIG. 1 is a sectional view through a head of an example cone crusher.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting 'a' element or 'an' element in the appended claims does not restrict those claims to articles, apparatuses, systems, methods, or the like having only one of that element.

The present disclosure generally concerns cone crushers. In some examples, a cone crusher may include a crushing cone held on a driven eccentric bushing, wherein the eccentric bushing rotates in a radial direction about a crusher shaft, which is designed as a spindle and is clamped fixedly in a receptacle provided in the housing lower part.

That said, one example object of the present disclosure is to design a maintenance-friendly and cost-effective cone crusher, in which the installation and also the removal of the spindle are easily possible even under adverse conditions and without the use of a heavy tool.

One aspect of the present disclosure is that the conical seat of the spindle, which conical seat is problematic for large cone crushers, can be replaced by a cylindrical seat and the spindle can be braced in a purely mechanical manner with a force fit in said cylindrical seat, wherein said bracing provides the same secure support as a conical seat, but avoids the disadvantages of the complex removal and installation and the difficult positioning of the oil ducts. This may be achieved in that the crusher shaft, which can be designed as a spindle, may comprise a cylindrical upper bearing portion which is braced in a bore forming the spindle receptacle. The force-fitting bracing is undertaken here by a clamping device that is accessible from the outside and is actuable purely mechanically, wherein the use of a conical clamping set, as is known from the prior art in particular for the production of shaft-hub-connections, for example, is appropriate as such a clamping device.

In order to be able to reliably compensate for the forces caused by the wobbling movement, the bracing of the spindle is advantageously undertaken not only via a single upper clamping device, but rather by means of two mechanical clamping devices which are arranged at an axial distance from each other and are dependent on the bending torque and are held in the housing lower part with a sufficiently large force engagement surface. Accordingly, in addition to the upper bearing portion, the spindle additionally comprises a cylindrical lower bearing portion which is clamped in a corresponding lower region of the annular space provided in the housing lower part by means of the second "lower" mechanical clamping device.

It is of particular advantage, because of the large clamping forces and because of the simple and therefore robust construction, if the two mechanical clamping devices for the production of the force-fitting connection are formed by conical clamping sets as are known per se from the prior art and are commercially available. As is known, such clamping sets have a conical inner ring (inner conical ring) and a correspondingly conical single- or two-part outer conical ring ("pressure ring"), wherein the conical surfaces of the rings slide on each other, and wherein inner ring and pressure ring are pulled over each other with tension means, in particular with clamping screws which are plugged through said rings and are combined into screw assemblies. With the displacement of the conical surfaces, because of the conical rings a radial force component arises from the axial prestressing force of the screws, said radial force component elastically shrinking the inner ring and expanding the outer ring such that compression is produced.

In order to facilitate the shrinkage and the expansion of the rings, it is particularly advantageous specifically in the case of the large-diameter clamping devices required for the present intended purpose, to use slotted inner and outer rings.

It is indeed expedient, for the use according to the invention of the clamping sets, but not absolutely necessary, for the rings to be continuous. As an alternative, clamping sets may also be formed by individual ring segments which are arranged symmetrically around the circumference of the spindle.

However, very generally, care should be taken in the case of the clamping sets to ensure that the cone angles are not too flat and it must be taken into account that there is the risk during the bracing of self-locking, which obstructs the later opening. Instead, the cone angles should be sufficiently steep such that, despite effective bracing, easy opening of the clamping sets when the clamping screws are released is nevertheless guaranteed. The spindle is removed in a simple manner by release of the screw assemblies of the two clamping sets. In particular, no additional aids, such as, for example, pressurized oil assemblies, are required. However, it may be advantageous to provide the pull-off threads which are known from commercially available clamping sets and into which screws can be screwed, which screws are then supported against the outer ring and drive the rings apart.

For the simple and precise installation and for the secure support of the spindle, it is furthermore advantageous to provide an axial stop in the spindle receptacle, against which axial stop the spindle lies with a correspondingly annular support. The spindle is then simply introduced from above into the spindle receptacle as far as the stop. The stop thus defines the exact axial fitted position of the spindle, in which fitted position in particular also the oil lines running in the spindle are reliably positioned. The annular support of the stop is advantageously realized by the fact that, firstly, the spindle and, secondly, the spindle receptacle in the lower region undergo a reduction in diameter. The annular support then arises at the transition between the two different diameters.

It is particularly advantageous here in respect of good accessibility and consequently for simple installation if the reduction in the diameter is provided between the upper and the lower bearing portion of the spindle, wherein the lower bearing portion has a smaller external size than the upper bearing portion. The clamping sets also have correspondingly different diameters. The screw assemblies of the upper clamping set are accessible from above, and those of the lower clamping set from below, during the installation.

In order to be able to securely brace spindles of particularly large diameters, it is advantageous to use conical clamping sets having radially divided pressure rings which lie virtually one behind another. In this case, the clamping sets have a front pressure ring which faces the inner ring, and a rear pressure ring, wherein the two pressure rings are acted upon via the by clamping screws which are assigned thereto and reach through the inner ring.

A particular advantage which arises from the bracing according to the invention of the spindle is, in addition to the robust construction of the cone crusher, especially also the relatively low overall height given a large diameter and correspondingly great efficiency at a high throughput. A further advantage of the bracing according to the invention is the substantially lower structural of complexity of the mounting in comparison to the previous conical bearing. In addition, separate fixing of the vertical fitted position of the spindle that is required in the case of the conical mounting can be dispensed with.

The invention therefore provides a maintenance-friendly and economically expedient alternative to the existing type of shaft fastening.

FIG. 1 first of all illustrates a section through the head of the cone crusher according to the invention. The material for crushing that is fed to the cone crusher is comminuted here between the fixed crushing ring 1 of the housing upper part 2 and the crushing cone 3 sitting on a conical seat of the cone carrier 4. The cone carrier 4 is set via the driven eccentric bushing 5 into a wobbling movement, as a result of which the crushing gap 6 between crushing ring 1 and crushing cone 3 changes in a continuously revolving manner. In the crushing gap 6, the material for crushing is comminuted by a squeezing and impact action until said material can leave the cone crusher through the crushing gap 6.

The driven eccentric bushing 5 rotates radially guided about a spindle 7 which is clamped fixedly in the housing lower part 8. For the axial supporting of the cone carrier 4, use is made of a spherical axial bearing 10 which is arranged on the head of a cylinder piston 9 and absorbs the wobbling movement of the cone carrier 4. The cylinder piston 9 is integrated in an end-side bore of the spindle 7 and permits the axial displacement of the cone carrier 4 with the crushing cone 3 sitting thereon, which leads to the setting of the width of the crushing gap 6. The cylinder piston 9 is supplied with hydraulic oil via oil lines 18 placed into the spindle 7.

Figure 2:
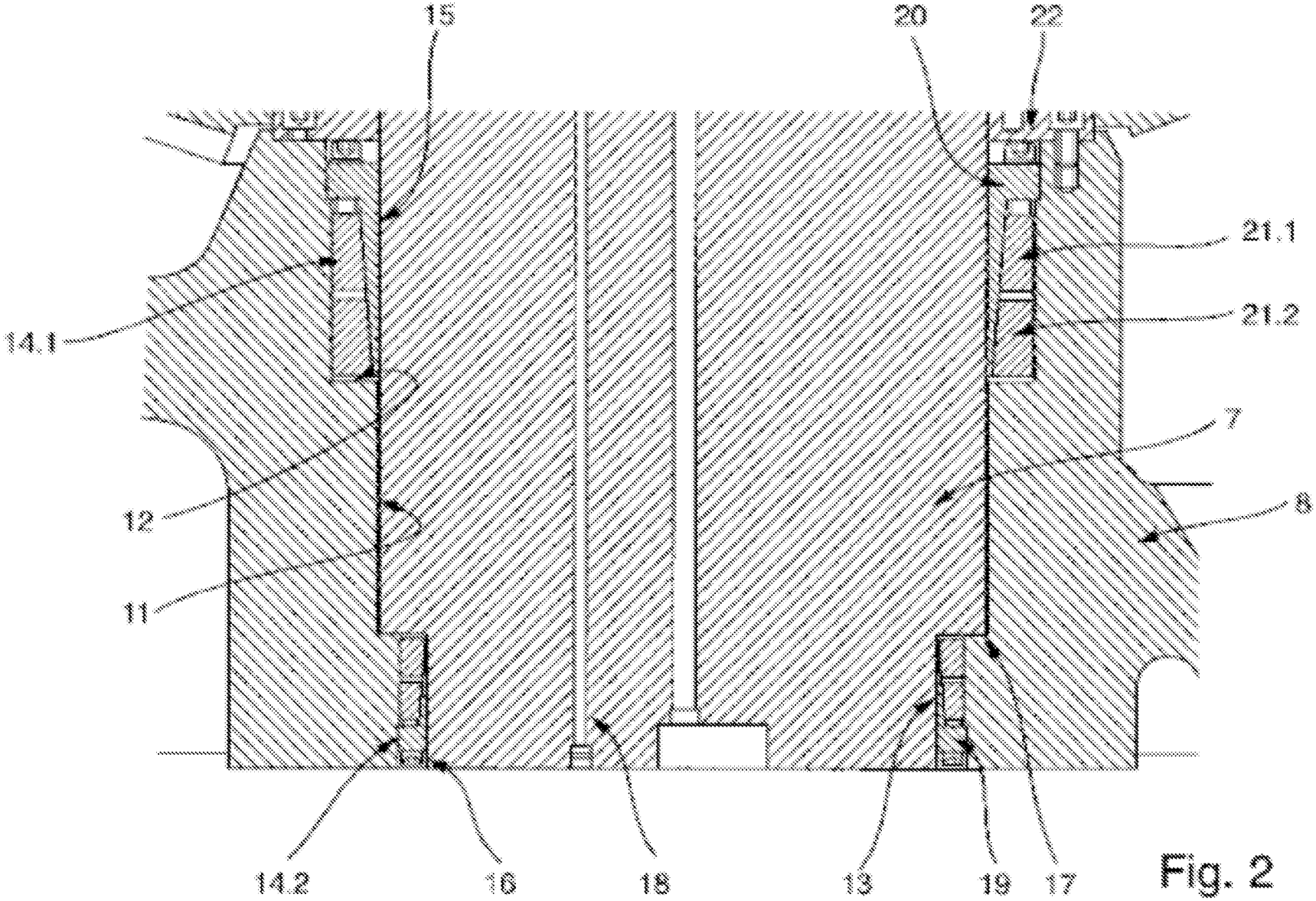
FIG. 2 is a detail view of example conical clamping sets.

The spindle 7 is of rotationally cylindrical design and is pushed into the corresponding spindle receptacle 11, which is provided in the housing lower part 8 and is designed as a bore, wherein a sufficiently large amount of play is provided between the spindle 7 and the spindle receptacle 11. For the purpose of bracing the spindle 7 within the spindle receptacle 11, said spindle has a cylindrical upper bearing portion 15 (FIG. 2) which is braced in the spindle receptacle by means of an upper mechanical clamping device in the form of a conical clamping set 14.1. The conical clamping set 14.1 is received here in an annular space 12 provided in the spindle receptacle 11.

In the present exemplary embodiment, the spindle 7 is additionally held via a second lower bracing means 14.2. For this purpose, said spindle has a cylindrical lower bearing portion 13 which is clamped in a lower region of the the spindle receptacle 11 by means of a corresponding lower mechanical clamping device in the form of a further conical clamping set 14.2 of smaller diameter. In this case, the annular space 16 which receives the clamping set 14.2 is taken out of the spindle. The fastening of the spindle 7 is therefore characterized in that the latter is clamped in the housing lower part 8 via two bending-torque-dependent, differently sized clamping sets 14.1 and 14.2 having a sufficiently large force engagement surface. The clamping sets 14.1 and 14.2 are fitted via the two annular spaces 12 and 16 into two constructional portions, which are provided for this purpose and are designed as cylindrical guides, between spindle and spindle receptacle.

As is apparent from the figures, the spindle 7 lies against a stop 17 which is formed by the spindle receptacle 11. For this purpose, between the upper bearing portion 15 and the lower bearing portion 13 a transition is provided from a small to a larger bore diameter and, in a corresponding manner on the spindle 7, a transition is provided from a larger to a small shaft diameter. This stop 17 in the axial direction defines the fitting depth of the spindle 7 in the spindle receptacle 11.

The clamping sets used in this embodiment each have three elements which are displaceable in relation to one another, wherein the required clamping force is set via corresponding screw assemblies. As is apparent, the upper clamping set 14.1 is oriented in such a manner that the conical inner ring 20 lying against the upper bearing portion 15 tapers downward toward the lower bearing portion 13. By contrast, the lower clamping set 14.2 is oriented in such a manner that the conical inner ring 19 lying against the lower bearing portion 13 tapers upward toward the upper bearing portion 15.

In the embodiment, use is made of commercially available clamping sets 14.1, 14.2 which each comprise a closed inner ring 20 and two closed pressure rings 21.1 and 21.2 lying one behind the other, wherein each of the pressure rings 21.1 and 21.2 is braced via a separate screw assembly 22. The upper clamping set 14.1 is oriented here in such a manner that the heads of the screws 22 are accessible from above when the eccentric bushing is removed, wherein the lower clamping set 14.2 can be braced by screws, the heads of which are accessible from below.

What is claimed is:

1. A cone crusher comprising:

a housing lower part having a spindle receptacle configured as a bore;

a spindle that is fixedly clamped in the spindle receptacle of the housing lower part;

a driven eccentric bushing that is disposed about the spindle and rotates radially;

a crushing cone held on the driven eccentric bushing;

an upper mechanical clamping device that braces a cylindrical upper bearing portion of the spindle in the bore, wherein the cylindrical upper bearing portion has a constant diameter; and a lower mechanical clamping device that braces a cylindrical lower bearing portion of the spindle in a lower region of the bore, wherein the cylindrical lower bearing portion has a constant diameter, wherein the spindle receptacle comprises a stop wherein a larger bore diameter at the cylindrical upper bearing portion transitions to a smaller bore diameter at the cylindrical lower bearing portion, wherein the spindle includes a transition from a larger bore diameter at the cylindrical upper bearing portion to a smaller bore diameter at the cylindrical lower bearing portion.

2. The cone crusher of claim 1 wherein each of the upper and lower mechanical clamping devices comprises a clamping set that includes a conical inner ring and a conical outer ring that acts as a pressure ring, wherein the conical inner and outer rings are closed rings.

3. The cone crusher of claim 2 wherein the clamping set of the upper mechanical clamping device is received in an annular space of the spindle receptacle, wherein the clamping set of the lower mechanical clamping device is received in an annular space of the cylindrical lower bearing portion of the spindle.

4. The cone crusher of claim 2 wherein dimensions of the spindle and the spindle receptacle correspond to dimensions of the clamping sets.

5. The cone crusher of claim 4 wherein the conical outer ring of each clamping set that acts as the pressure ring is a first pressure ring, wherein each of the clamping sets further comprises a second closed pressure ring, wherein the first and second pressure rings lie one behind the other, wherein each of the pressure rings is braced via a separate screw assembly.

6. The cone crusher of claim 2 wherein the clamping set of the upper mechanical clamping device is oriented so that the conical inner ring lying against the cylindrical upper bearing portion tapers downward toward the cylindrical lower bearing portion, wherein the clamping set of the lower mechanical clamping device is oriented so that the conical inner ring lying against the cylindrical lower bearing portion tapers upward toward the cylindrical upper bearing portion.

7. The cone crusher of claim 6 wherein the clamping set of the upper mechanical clamping device is configured to be braced by fasteners, wherein heads of the fasteners are accessible from above when the eccentric bushing is removed, wherein the clamping set of the lower mechanical clamping device is configured to be braced by fasteners, wherein heads of the fasteners configured to brace the lower mechanical clamping device are accessible from below.

8. The cone crusher of claim 1 wherein the stop of the spindle receptacle is a first seat disposed between the upper and lower mechanical clamping devices, wherein the transition of the spindle is a second seat that engages with and is supported by the first seat of the spindle receptacle.

9. The cone crusher of claim 8 wherein the first and second seats are horizontal.

10. The cone crusher of claim 9 wherein the lower mechanical clamping device is adjacent to the first and second horizontal seats.

* * * * *